US008138993B2

(12) United States Patent
Bourgoin et al.

(10) Patent No.: US 8,138,993 B2
(45) Date of Patent: Mar. 20, 2012

(54) CONTROL OF A PLASMA DISPLAY PANEL

(75) Inventors: Jerome Bourgoin, Fontaine (FR); Gilles Troussel, Grenoble (FR)

(73) Assignee: STMicroelectronics SA, Montrouge (FR)

( * ) Notice: Subject to any disclaimer, the term of this patent is extended or adjusted under 35 U.S.C. 154(b) by 977 days.

(21) Appl. No.: 11/753,189

(22) Filed: May 24, 2007

(65) Prior Publication Data

US 2007/0285355 A1 Dec. 13, 2007

(30) Foreign Application Priority Data

May 29, 2006 (FR) ..... 06 51941

(51) Int. Cl.
*G09G 3/28* (2006.01)

(52) U.S. Cl. ..... 345/60; 345/37; 345/41; 315/111.21; 315/111.71; 315/169.3; 315/169.4; 313/582; 313/583; 349/32

(58) Field of Classification Search ..... 345/60–72; 315/111.21, 111.71, 169.3, 169.4; 313/582–583; 349/32

See application file for complete search history.

(56) References Cited

U.S. PATENT DOCUMENTS

| | | | | |
|---|---|---|---|---|
| 5,684,499 | A * | 11/1997 | Shimizu et al. | 345/60 |
| 6,215,463 | B1 | 4/2001 | Matsumoto et al. | 345/80 |
| 6,232,948 | B1 | 5/2001 | Tsuchi | 345/99 |
| 2003/0006713 | A1 * | 1/2003 | Kim et al. | 315/169.2 |
| 2003/0107327 | A1 | 6/2003 | Mas et al. | 315/169.3 |
| 2004/0080279 | A1 | 4/2004 | Maede et al. | 315/169.3 |
| 2004/0233148 | A1 | 11/2004 | Tanghe et al. | 345/83 |
| 2005/0052361 | A1 * | 3/2005 | Mizobata et al. | 345/60 |
| 2005/0264499 | A1 | 12/2005 | Kim et al. | 345/76 |
| 2006/0118700 | A1 | 6/2006 | Chaussy et al. | 250/214.1 |
| 2006/0119551 | A1 | 6/2006 | Chaussy et al. | 345/76 |

FOREIGN PATENT DOCUMENTS

| | | |
|---|---|---|
| EP | 1566790 | 8/2005 |
| EP | 1 605 432 | 12/2005 |
| FR | 2 879 007 | 6/2006 |
| FR | 2 879 008 | 6/2006 |

* cited by examiner

*Primary Examiner* — Kevin M Nguyen
*Assistant Examiner* — Cory Almeida
(74) *Attorney, Agent, or Firm* — Seed IP Law Group PLLC

(57) ABSTRACT

The control of a plasma display panel, successively comprises, at least for all the cells of a current line having to switch state for the next line: a connection of a terminal of application of an intermediary supply voltage to output terminals of column control stages corresponding to the junction points of first and second switches between two terminals of application of a supply voltage, to perform a precharge or a predischarge of the screen cells; a disconnection of said output terminals from this intermediary voltage; and a connection of each output terminal to a first or to a second power supply voltage by the turning-on of the first or second switch of the corresponding stage, according to a luminance reference value, delayed with respect to the disconnection of the corresponding output terminal from the terminal of application of the intermediary voltage.

25 Claims, 5 Drawing Sheets

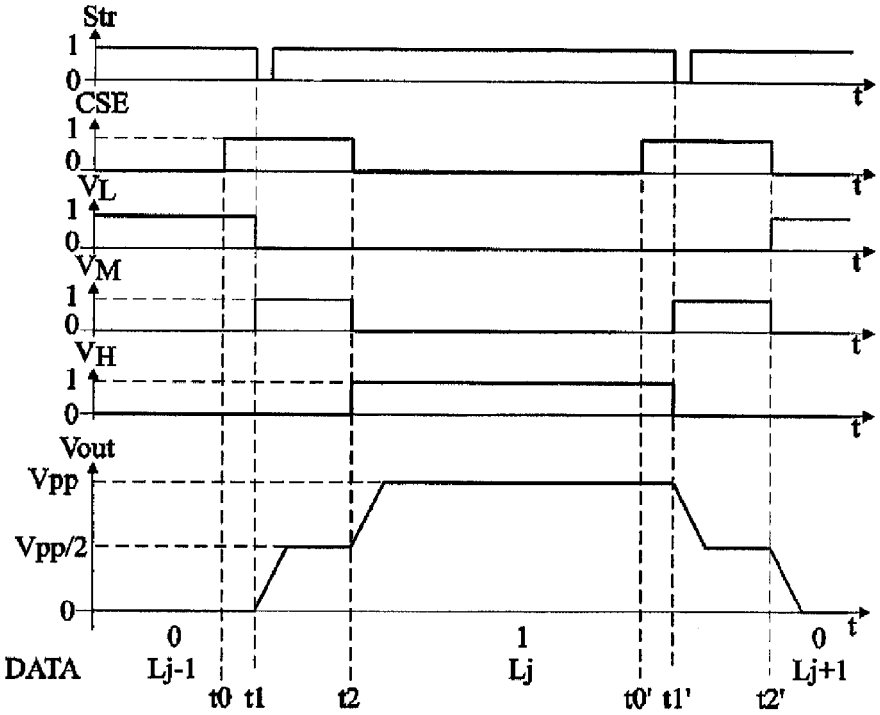
FIG. 5A (Prior Art)
FIG. 5B (Prior Art)
FIG. 5C (Prior Art)
FIG. 5D (Prior Art)
FIG. 5E (Prior Art)
FIG. 5F (Prior Art)
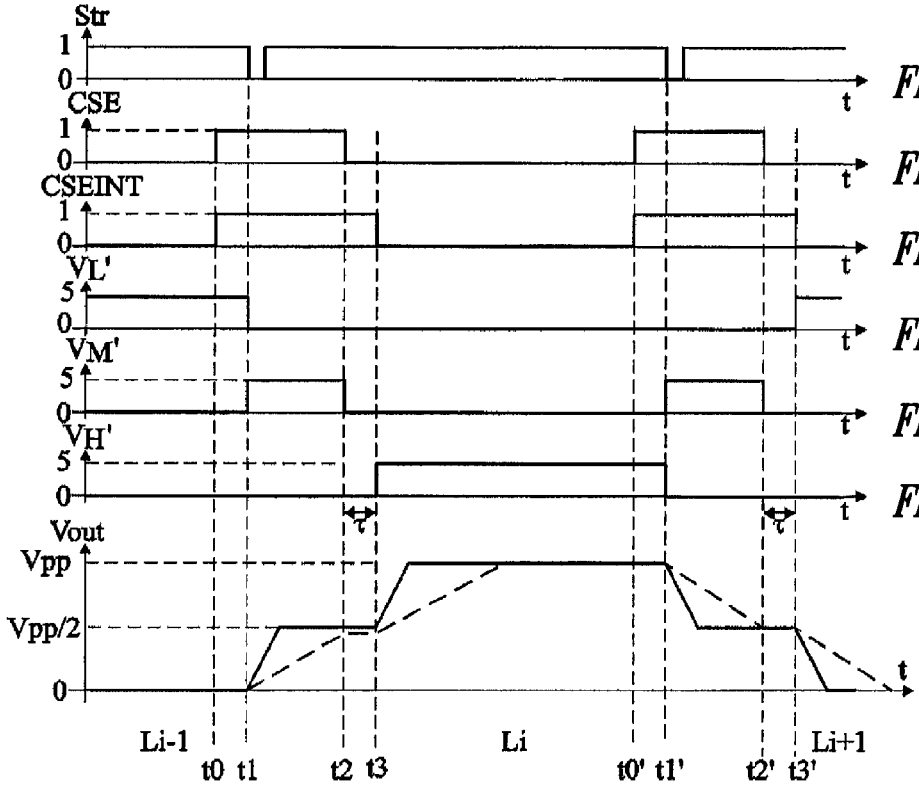
FIG. 6A
FIG. 6B
FIG. 6G
FIG. 6C
FIG. 6D
FIG. 6E
FIG. 6F

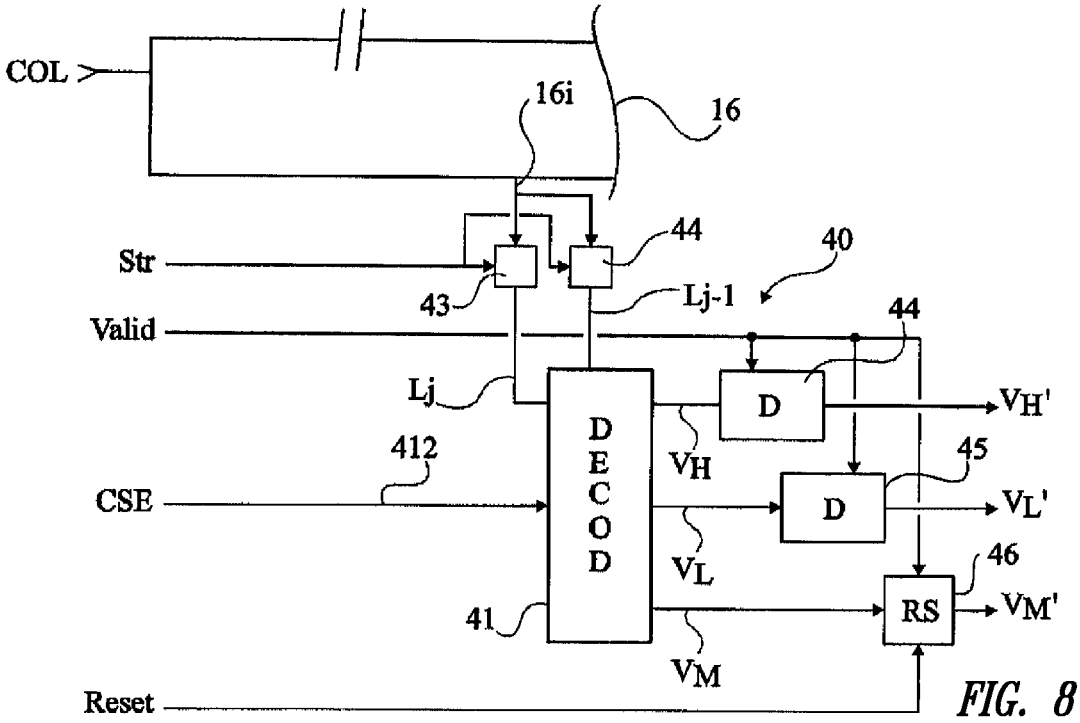
FIG. 8
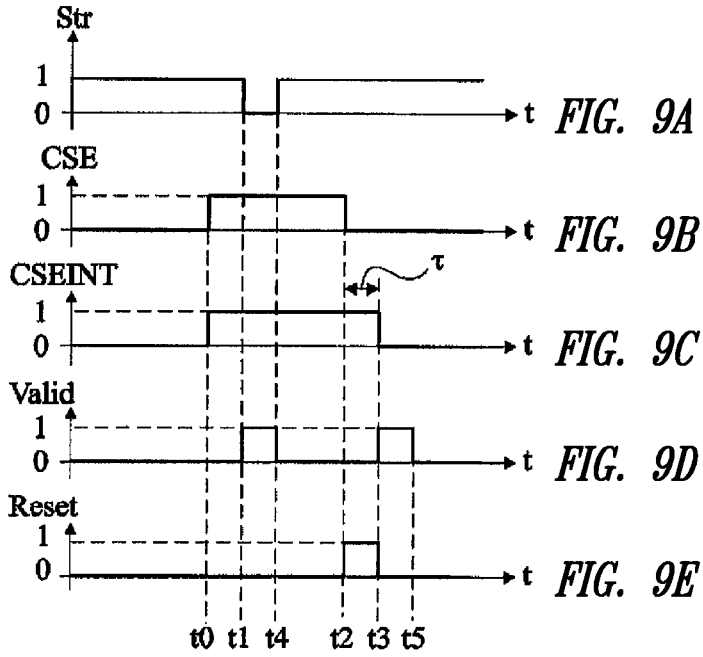
FIG. 9A
FIG. 9B
FIG. 9C
FIG. 9D
FIG. 9E

CONTROL OF A PLASMA DISPLAY PANEL

BACKGROUND OF THE INVENTION

1. Field of the Invention

The present invention generally relates to plasma display panels and, more specifically, to the control of a plasma display panel power stage.

2. Description of the Related Art

A plasma display panel is formed of an array of cells arranged at the intersection of lines and columns. Each cell of the display panel comprises a cavity filled with a gas and at least two control electrodes. To create a light spot on the display panel by using a given cell, a potential difference is applied between the control electrodes thereof, the gas contained in the cell being then ionized, generally by means of a third electrode. This ionization comes along with an ultraviolet ray emission, the light spot creation being obtained by excitation of a red, green, or blue light-emitting material by these rays.

FIG. 1 very schematically shows in the form of blocks a conventional example of a plasma display panel formed of a network of cells represented in FIG. 1 by their equivalent capacitances 2. Each cell comprises two electrodes respectively connected to a line 4 and to a column 6. A line control circuit 8 (SCAN) comprises, for each line 4, an activation/deactivation circuit having an output connected to the considered line. A column control circuit 12 comprises an element 16 (DATA) (generally of shift register type) for parallelizing address data received in series (signal COL) and, for each column 6, a control circuit or stage 14 having an output O connected to the considered column 6 and receiving, on input data E, reference signals generated from the luminance data. Elements 14 and 16 are generally integrated in a same circuit 12. A general circuit 10 (CTRL) for controlling the display panel synchronizes the operation of circuits 8 and 12.

The display panel cells are activated in a line scanning by means of circuit 8. The non-activated lines are submitted to a quiescent voltage (generally greater than 100 volts), while the activated line is brought to an activation voltage (generally, 0 volt). The quiescent voltage of a column corresponds to ground. To activate cells based on the data provided by circuit 16 on the active line, the corresponding columns are brought to an activation voltage Vpp generally on the order of 70 volts for a given period.

The voltage difference between an activated line and a column (about 70 volts) provides lighting of the selected cell. The third electrode (not shown in FIG. 1), called support electrode, provides for adjusting the luminance of the selected cells (memory effect).

FIG. 2 illustrates, in a very simplified partial representation of three control stages $\mathbf{14}_{i-1}$, $\mathbf{14}_{i}$, and $\mathbf{14}_{i+1}$ of columns $C_{i-1}$, $C_i$, and $C_{i+1}$, a conventional example of precharge or predischarge of cells of a plasma display panel of the type shown in FIG. 1. The function is to limit the screen consumption to bring the respective column electrodes to the activation voltage. For example, an external capacitor with a capacitance greater than the total equivalent capacitance of the panel is used, to store power on discharge of a line which has just been addressed and prepare the charge of the next line. Each output terminal O of a circuit 14 is connected to the junction point of two switches P1 and N1 in series between two terminals of application of activation voltage $V_{PP}$. Switches K connect terminals O to a terminal 24 which is at a voltage $V_{PP}/2$ (for example, the first electrode of the capacitor, which has its second electrode at ground). The control of switches P1, N1, and K of each stage is organized to, between each line $L_j$, enable recovering charges of the columns to be discharged (cells to be turned off) for the benefit of columns to be charged (cells to be turned on). It is then spoken of charge sharing. Voltage $V_{PP}/2$ of terminal 24 may also be obtained by an internal or external voltage source or by any other means. In FIG. 2, the cumulated equivalent capacitances of the cells of columns $C_{i-1}$, $C_i$, and $C_{i+1}$ have been represented by capacitances $\{\mathbf{2}\}_{i-1}$, $\{\mathbf{2}\}_{i}$, and $\{\mathbf{2}\}_{i+1}$ in dotted lines.

FIG. 3 shows the electric diagram of a circuit 14 for controlling a column (represented by its equivalent capacitance {2} in dotted lines). Switches P1 and N1 formed of MOS transistors, respectively with a P and N channel, in series between two terminals 20 and 22 of application of voltage $V_{PP}$, are each in parallel with a diode D16 or D18 (for example, their respective parasitic diodes). The anode of diode D16 is connected to the drain of transistor P1 (output terminal O of the stage), the source of transistor P1 being connected to terminal 20. The anode of diode D18 is connected to ground 22, the source of transistor N1 being also connected to ground 22, and its drain being connected to terminal O. Bidirectional switch K is formed of two N-channel MOS transistors N2 and N3 in series and with a common source of terminal 24 at voltage $V_{PP}/2$ and terminal O. Two diodes D26 and D28, for example corresponding to the parasitic diodes of transistors N2 and N3, have their respective anodes connected to midpoint 30 of switch K. The gates of transistors N2 and N3 are connected together to the drain of a P-channel MOS transistor P2, mirror-assembled on a P-channel MOS transistor P3. Transistor P3 is in series with a control transistor N4 and a current source 34 between terminal 20 and ground 22.

The control of circuit 14 is performed by means of three signals $V_H$, $V_L$, and $V_M$. A level-shifting circuit 36 (LS), controlled by signal $V_H$ referenced to ground, is interposed between terminal 20 and the gate of transistor P1. Signal $V_L$ is directly applied to the gate of transistor N1 while signal $V_M$ is applied to that of transistor N4. The function of signals $V_L$, $V_H$, and $V_M$ is to control circuit 14 to organize the precharge and predischarge of the addressed cells between the actual display periods.

FIG. 4 very schematically shows in the form of blocks an amplifier 14 and partially shows column control circuit 16, to illustrate the different signals received by these circuits. Circuit 16 receives, from circuit 10, a signal CSE (Charge Sharing Enable) for controlling the precharge or predischarge and a synchronization signal Str. Signal CSE is active at state 1 while signal Str indicates, by ground pulses, the times of switching of the column data of the shift register of circuit 16 to circuits 14 for generation of signals Out.

FIGS. 5A, 5B, 5C, 5D, 5E, and 5F illustrate in timing diagrams the operation of amplifier 14 of FIGS. 3 and 4 for the lighting (signal DATA at 1) of a cell at the intersection of a line $L_j$ and of the considered column $C_i$. In FIG. 5, preceding and next lines $L_{j-1}$ and $L_{j+1}$ are assumed not to have to be lit for the current column (signal DATA at 0).

Signals $V_L$ (FIG. 5C), $V_M$ (FIG. 5D), and $V_H$ (FIG. 5E) are generated by circuit 16 based on signals Str (FIG. 5A) and CSE (FIG. 5B) by taking into account the data to be displayed of the preceding columns. An example of a circuit for generating signals $V_L$, $V_M$, and $V_H$ is described in U.S. Pat. No. 7,122,968.

The function of signals $V_L$, $V_M$, and $V_H$ is to control amplifier 14 to obtain a precharge to level $V_{PP}/2$ of the concerned column (voltage Vout, FIG. 5F) before completing this charge through transistor P1. Conversely, at the end of the column addressing, these signals are used to organize the cell discharge towards terminal 24 before ending this discharge through transistor N1.

Assuming that the datum of the preceding line $L_{i-1}$ is 0, signals $V_M$ and $V_H$ are low until time t1 of the pulse of signal Str, so that transistors P1 and N4 are blocked while transistor N1 is on. At a time t0, preceding time t1 towards the end of the addressing of line $L_{i-1}$, signal CSE is switched to state 1 to activate the charge transfer system. At time t1 when signal Str switches to the low state to transfer the data from the shift register to circuits 14, signal $V_L$ switches to the low state to block transistor N1 while signal $V_M$ switches to the high state to turn on transistor N4. Since terminal O is in the low state, this results in a turning-on of transistor N2 and a precharge (FIG. 5F) of node O approximately up to level $V_{PP}/2$ via transistor N2 and diode D28, which is then forward biased. With a capacitor providing level $V_{PP}/2$, the increase in voltage Vout actually lasts until the charges are balanced between this capacitor and the equivalent capacitances of the addressed display panel cells. At a time t2, signal CSE returns to the low state, which causes a low switching of the transistor of signal $V_M$ and a high switching of signal $V_H$. This results in a turning-off of transistor N4, which in turn results in a turning-off of transistor N2 and of switch K, and a turning-on of transistor P1 to complete the charge of the cells of the addressed column up to level $V_{PP}$. A little before the end of the addressing of current line $L_i$ (time t0'), signal CSE switches back to the high state, indicating an activation of the precharge or predischarge circuit. At a following time t1', the pulse on signal Str causes the high switching of signal $V_M$ as at time t1 and due to the data level 0 desired for the next line $L_{i+1}$, signal $V_H$ switches to the low state while signal $V_L$ remains therein. This results in a discharge of the cells charged to level $V_{PP}$ during the previous period to reach level $V_{PP}/2$. As for the previous period, when signal CSE switches back to the low state (time t2'), this causes the carrying on of the discharge to 0 by the switching to the high state of signal $V_L$ and the turning-off of transistor N4 (switching to the low state of signal $V_M$).

For the case where a next line in the scan order has to keep the same level, the predischarge (times t1' to t2') does not occur.

As compared with still prior solutions based on the use of a PMOS transistor to form switch K, the use of two DMOS transistors N2 and N3 space, a switch K having to be provided for each column.

However, a disadvantage of the circuit of FIG. 3 is a static consumption on turning-on of switch K.

Another disadvantage is a risk of simultaneous conduction of transistors N2 and N3 and of transistor P1 at time t2, causing a short-circuit between supply line 20 at level Vpp and terminal 24 at level $V_{PP}/2$. The same problem occurs at time t2' with the ground.

The risk of simultaneous conduction is partly linked to the stray capacitances of the gates of transistors N2 and N3 which, when added to the stray drain capacitance of transistor P1, generate a switching delay. The risk of simultaneous conduction also originates from the recovery time of diodes D26 or D28 according to the initial cell biasing.

An additional constraint in display panels of the type to which the present invention applies is that it is not desirable to multiply the number of input signals of the column control circuits, which are in practice made in an integrated circuit. This is among others justified by a need for a compatibility of the column control circuit with the rest of the circuits.

BRIEF SUMMARY OF THE INVENTION

One embodiment of the present invention overcomes all or part of the disadvantages of known circuits for controlling power stages of circuits of plasma display panel columns.

One embodiment of the present invention more specifically addresses the problems of simultaneous conduction of precharge transistors of the cells of such a display panel with one of the transistors for providing the bias voltage to the concerned cell.

One embodiment of the present invention provides a solution that does not require an additional terminal for the column control circuit.

One embodiment of the present invention provides a method for controlling a plasma display panel, successively comprising, at least for all the cells of a current line having to switch state for the next line:

a connection of a terminal of application of an intermediary supply voltage to output terminals of column control stages corresponding to the junction points of first and second switches between two terminals of application of a supply voltage, to perform a precharge or a predischarge of the screen cells;

a disconnection of said output terminals from this intermediary voltage; and a connection of each output terminal to a first or to a second power supply voltage by the turning-on of the first or second switch of the corresponding stage, according to an addressing reference value, delayed with respect to the disconnection of the corresponding output terminal from the terminal of application of the intermediary voltage.

According to an embodiment of the present invention, the delay is obtained by a resistive and capacitive cell for shifting an edge of deactivation of a signal of activation of the precharge or predischarge.

According to an embodiment of the present invention, said delay is selected according to the recovery time of parasitic diodes of N-channel MOS transistors forming a switch of connection of said intermediary voltage to the output terminals.

According to an embodiment of the present invention, an internal signal is generated from the precharge or predischarge activation signal.

According to an embodiment of the present invention, said internal signal is used to generate signals of activation and reset of flip-flops placed at the output of a circuit for generating control signals of said column control stage switches.

One embodiment of the present invention provides a circuit for controlling a column of a plasma display panel.

One embodiment of the present invention provides a plasma display panel.

The foregoing and other features and advantages of the present invention will be discussed in detail in the following non-limiting description of specific embodiments in connection with the accompanying drawings.

BRIEF DESCRIPTION OF THE SEVERAL VIEWS OF THE DRAWINGS

FIGS. 5A, 5B, 5C, 5D, 5E, and 5F illustrate in timing diagrams an example of operation of the circuit of FIGS. 3 and 4;

FIGS. 6A, 6B, 6C, 6D, 6E, 6F, and 6G illustrate in timing diagrams an embodiment of the control method according to the present invention;

FIG. 8 very schematically shows in the form of blocks an embodiment of a circuit for generating signals exploited by the method of one embodiment of the present invention;

FIGS. 9A, 9B, 9C, 9D, and 9E illustrate an example of the shape of signals internal to the circuit of FIG. 8.

DETAILED DESCRIPTION OF THE INVENTION

Figure 1:
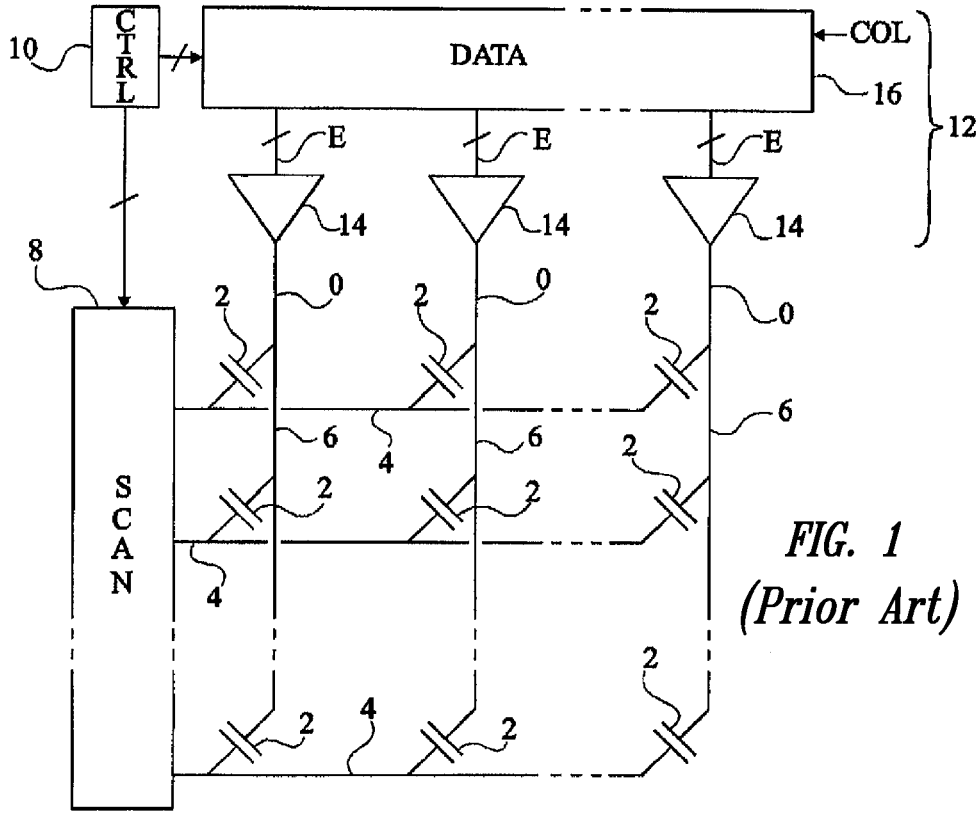
FIG. 1 (Prior Art)
FIG. 1, previously described, very schematically shows in the form of blocks an example of architecture of a plasma display panel of the type to which the present invention applies.

Same elements have been designated with same reference numerals in the different drawings which have been drawn out of scale. For clarity, only those steps and elements which are useful to the present invention have been shown and will be described. In particular, the generation of the luminance reference values and the generation of the scan control signals have not been shown, the present invention being compatible with any conventional circuit generating such signals.

A feature of an embodiment of the present invention is to shift the switching of the transistors bringing a complement to the charge or discharge of the display panel cells with respect to the turning-off of the precharge or discharge control switch.

Another feature of an embodiment of the present invention is to provide a generation of control signals internal to the column control circuit, that is, exclusively based on the signals for making data available and activating the precharge and predischarge stage.

Figure 2:
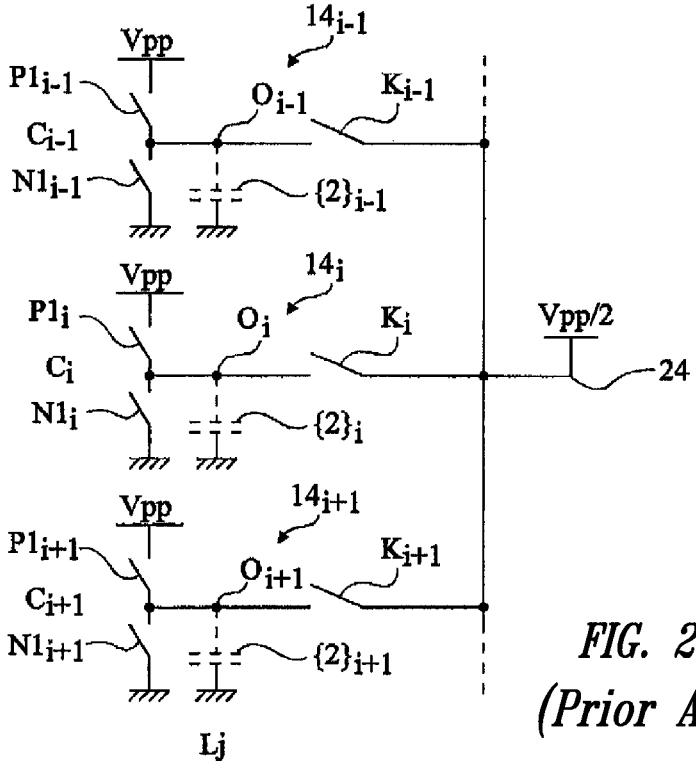
FIG. 2 (Prior Art)
FIG. 2, previously described, shows an example of conventional architecture of precharge and predischarge circuits of the type to which the present invention applies.
Figure 3:
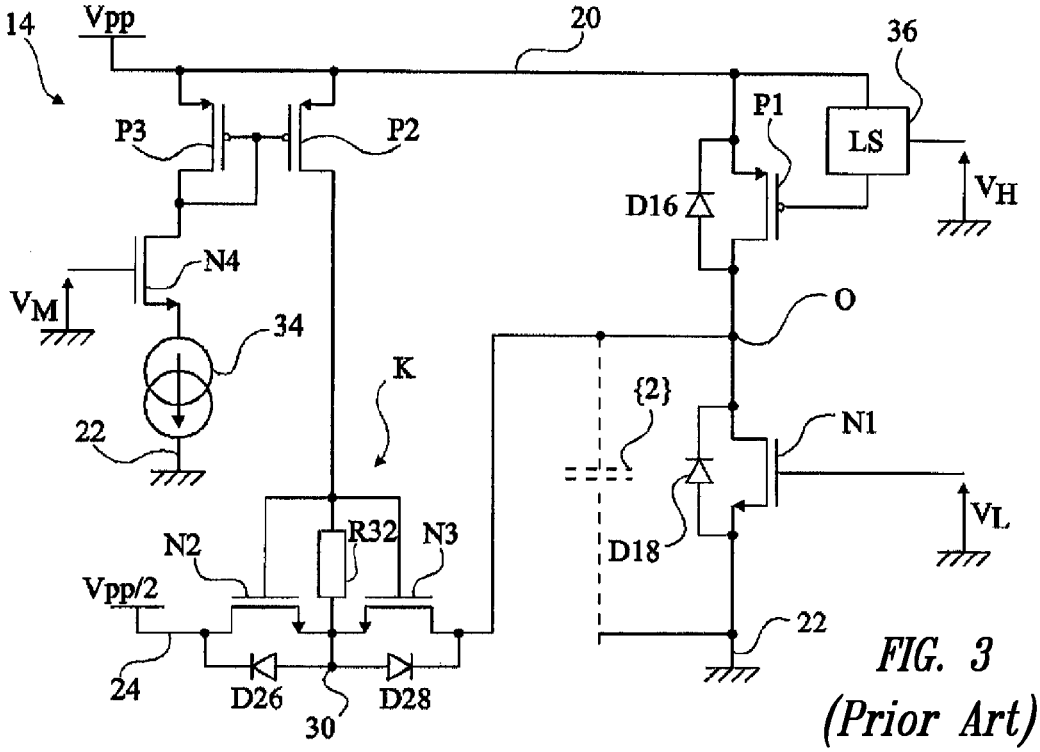
FIG. 3 (Prior Art)
FIG. 3, previously described, shows the electric diagram of a conventional plasma display panel column control circuit.
Figure 4:
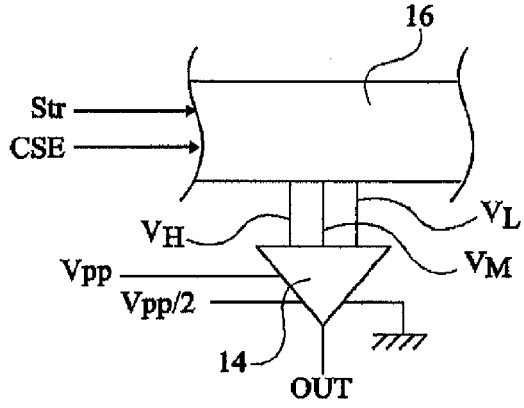
FIG. 4 (Prior Art)
FIG. 4, previously described, illustrates the signals received by a conventional control circuit.

One embodiment of the present invention exploits the conventional architecture of column control circuits such as previously described in relation with FIGS. 1, 2, and 3. For simplification, embodiments of the present invention will be described hereafter in relation with the elements and reference numerals of these drawings and will not be described again.

FIGS. 6A, 6B, 6C, 6D, 6E, 6F, and 6G illustrate in timing diagrams to be compared with those of FIGS. 5A-5F an embodiment of the present invention. The same situation as in FIGS. 5A-5F of a precharge to display a line $L_j$ with respect to a previous line $L_{j-1}$, then for a predischarge to turn off the next line $L_{j+1}$, is assumed.

As previously, signals Str (FIG. 6A) of control of the shift register of circuit 16 (FIG. 1) and CSE (FIG. 6B) of activation of the precharge or predischarge, originating from general control circuit 10, switch at times t1, t0 and t2, t0', t1', and t2. FIGS. 6A and 6B are identical to FIGS. 5A and 5B.

As previously still, control signal $V_{M'}$ of transistor N4 (FIG. 3) is switched to the high state at times t1 and t1', then to the low state at times t2 and t2', and signals $V_{L'}$ and $V_{H'}$ are switched to their respective low states according to the content of the columns to be addressed (in this example at times t1 and t1').

According to this embodiment of the present invention, time t3, respectively t3', of switching to the high state of signals $V_{H'}$ and $V_{L'}$ to turn on switch P1 or N1 and bring the charge or discharge complement, is delayed by a delay $\tau$ with respect to times t2 and t2' of switching of signal $V_{M'}$ to the low state, and thus with respect to the control signal for turning on switch K.

Delay $\tau$ may be obtained by internal generation of a signal CSEINT common to all circuits 14. Signal CSEINT exhibits a rising edge triggered by the rising edge of signal CSE (time t0) and a falling edge (time t3) delayed with respect to the falling edge of signal CSE. Signal CSEINT is obtained, for example, by delaying the falling edge of signal CSE by a time period $\tau$ by means of a resistive and capacitive cell based on signal CSE.

Figure 7:
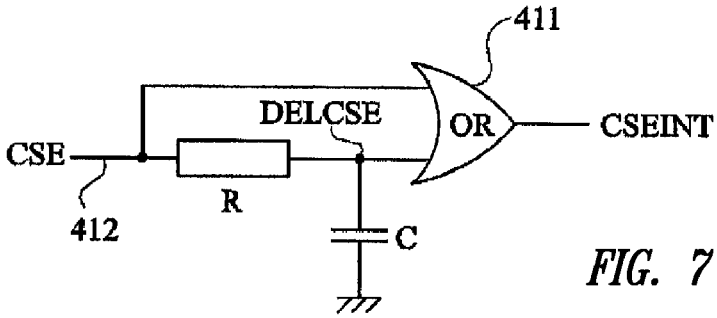
FIG. 7 shows an example of a circuit for obtaining an internal signal exploited by the method of one embodiment of the present invention.

FIG. 7 shows an example of a circuit for generating signal CSEINT from signal CSE. Other embodiments are of course possible.

In this example, an OR-type logic gate 411 combines signal CSE with a signal DELCSE obtained by delaying signal CSE by means of a resistive and capacitive cell formed of a resistor R between a terminal 412 receiving signal CSE and an input terminal of gate 411, and of a capacitor C connecting this input terminal to ground. The other terminal of gate 411 is directly connected to terminal 412 and the output of gate 411 provides signal CSEINT.

Delay $\tau$ (corresponding to the time constant of the RC cell) is selected to enable the diodes (D26 and D28, FIG. 3) to recover before turning-on of transistor P1 by signal $V_H$. The interval between times t1 and t2 is selected for level $V_{PP}/2$ to be reached at time t2 even on a maximum charge (dotted lines in FIG. 6F).

FIG. 8 very schematically shows in the form of blocks an embodiment of a circuit 40 for generating signals $V_{H'}$, $V_{M'}$, and $V_{L'}$ based on signals $V_H$, $V_M$, and $V_L$ provided by a decoding circuit 41 (DECOD) generating these signals based on signal CSE and on signal Str. An example of a circuit for obtaining signals $V_H$, $V_M$, and $V_L$ will be described subsequently in relation with FIG. 10. In the representation of FIG. 8, the generation of signal CSEINT (for example, by means of the circuit of FIG. 7) is assumed to be integrated to circuit 41. As illustrated in FIG. 8, for each output $\mathbf{16}_i$ of the shift register receiving series data COL (addressing reference values), two flip-flops 43 and 44 are used to store two data from this columns for two successive lines to be able to take into account, for a current line $L_i$, states of the previous line $L_{i-1}$ in the generation of signals $V_H$ and $V_L$.

According to this embodiment of the present invention, two D-type flip-flops 44 and 45 respectively receive signals $V_H$ and $V_L$ generated by decoder 41 as the signals of FIGS. 5E and 5C and provide signals $V_{H'}$ and $V_{L'}$. Flip-flops 44 and 45 are controlled by a signal Valid causing the transfer of the state present at the input (signal $V_H$ or $V_L$) to the output of the concerned flip-flop. A third RS-type flip-flop 46 receives signal $V_M$ and is controlled by signal Valid. Flip-flop 46 provides signal $V_{M'}$ and receives a reset signal Reset. Signals Valid and Reset are generated from signals Str, CSE, and CSEINT and may be common to all circuits 14.

FIGS. 9A, 9B, 9C, 9D, and 9E illustrate an example of generation of signals Valid and Reset (FIGS. 9D and 9E) according to the shapes of signals Str (FIG. 9A), CSE (FIG. 9B), and CSEINT (FIG. 9C).

Signal Valid is, for example, obtained by logic recombination of signals Str, CSE, and CSEINT. Signal Reset exhibits a pulse between times t2 and t3. This signal is, for example, obtained by a logic XOR-type combination of signals CSE and CSEINT. On the side of signal Valid, a first pulse (between times t1 and t4) corresponds to the pulse inverse to that of signal Str and a second pulse occurs between time t3 and a slightly later time t5. This second pulse of signal Valid is, for example, obtained by means of a resistive and capacitive cell. The first pulse of signal Valid is obtained, for example, by AND-type combination of signal CSEINT with the result of an XOR-type combination of signals Str and CSE.

As a variation, the durations of all the pulses of signals Valid and Reset are set by resistive and capacitive cells.

The generation of signals Valid and Reset to control flip-flops 44 to 46 of FIG. 8 enables taking into account the real operating conditions of the display panel and especially the extreme conditions of a need for precharge or predischarge of the display panel cells.

Figure 10:
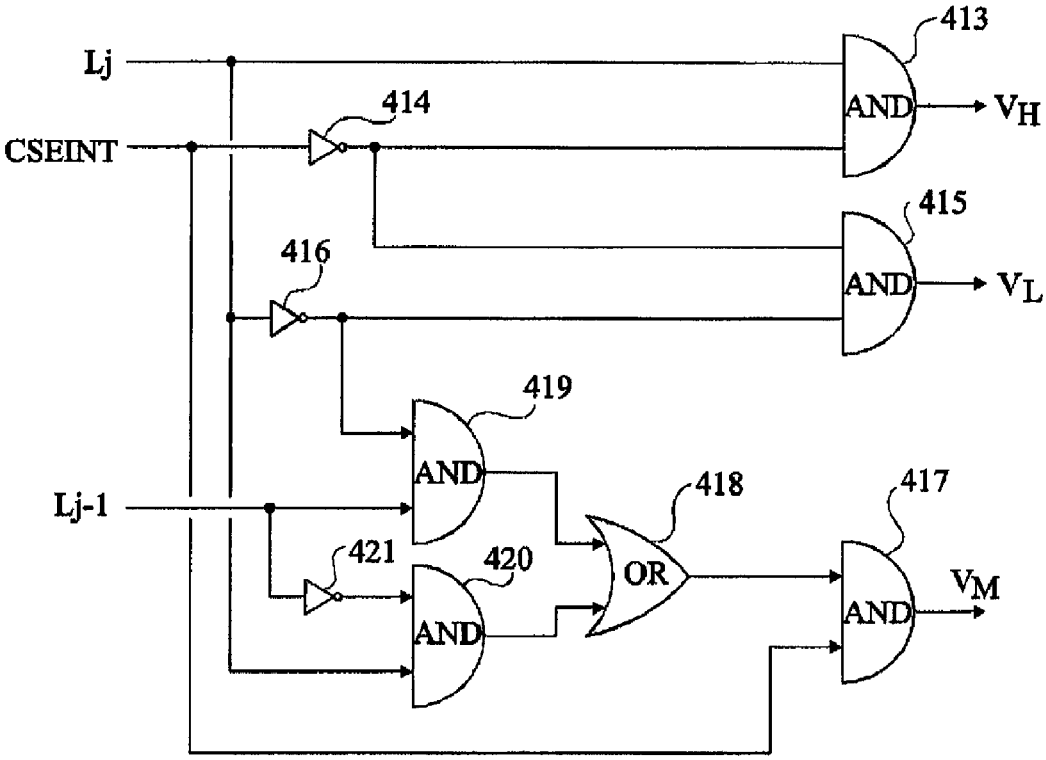
FIG. 10 shows an embodiment of a detail of the circuit of FIG. 8.

FIG. 10 shows an example of a circuit for generating signals $V_H$, $V_L$, and $V_M$. Other circuits are of course possible. In the shown example, a logic AND-gate 413 combines signal $L_j$ and the inverse of signal CSEINT (inverter 414), and provides signal $V_H$. A logic AND-type gate 415 receives the output of inverter 414 (inverse of signal CSEINT) and the inverse of signal $L_j$ (inverter 416), and provides signal $V_L$. Signal $V_M$ is provided by a logic AND-type gate 417 which combines signal CSEINT with the result provided by a logic OR-type gate 418 combining the respective results of two AND-type gates 419 and 420 respectively receiving signal $L_{j-1}$ and the inverse of signal $L_j$, and the inverse of signal $L_{j-i}$ (inverter 421) and signal $L_j$.

An advantage of the embodiments described above is that they enable in simple fashion and without using additional external signals, avoiding the problems of simultaneous conduction in a screen of plasma display panel type.

Another advantage is that they do not adversely affect the advantages brought by control circuits based on DMOS transistors over the use of PMOS transistors.

Another advantage is that they are compatible with any conventional structure of a plasma display panel column and line addressing circuit.

Of course, the present invention is likely to have various alterations, improvements, and modifications which will readily occur to those skilled in the art. In particular, the practical generation of the signals useful for the implementation of the present invention is within the abilities of those skilled in the art based on the functional indications given hereabove. For example, the active and inactive levels may be adapted according to the control circuits.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

What is claimed is:

1. A method for controlling a plasma display panel, comprising:

performing a precharge or a predischarge of at least all cells of a current line that have to switch state for a next line by connecting an intermediate supply terminal that applies an intermediary supply voltage to output terminals of column control stages corresponding to junction points of first and second switches between first and second supply voltage terminals that apply first and second supply voltages, respectively, the intermediary supply voltage maintaining a voltage between the first and second supply voltages;

disconnecting said output terminals from the intermediate supply terminal; and connecting each output terminal to the first or to the second power supply voltage by turning on the first or second switch of a corresponding stage of the column control stages, according to an addressing reference value, wherein, during the precharge or the predischarge, said act of connecting each output terminal to the first or to the second power supply voltage is delayed at the intermediary supply voltage with respect to the act of disconnecting the output terminal from the intermediate supply terminal.

2. The method of claim 1, wherein said connecting step is delayed by a delay that is selected according to a recovery time of parasitic diodes of N-channel MOS transistors forming a switch of connection of said intermediary voltage to the output terminals.

3. The method of claim 1, wherein the delay is obtained by a resistive and capacitive cell structured to delay an edge of deactivation of a precharge or predischarge activation signal that activates the precharge or predischarge.

4. The method of claim 3, further comprising generating an internal signal from the precharge or predischarge activation signal.

5. The method of claim 4, further comprising generating, from said internal signal, activation and reset signals that respectively activate and reset flip-flops placed at an output of a circuit structured to generate control signals of said column control stage switches.

6. A circuit to control a plasma display panel, comprising:

performing means for performing a precharge or a predischarge of at least all cells of a current line that have to switch state for a next line by connecting an intermediate supply terminal that applies an intermediary supply voltage to output terminals of column control stages corresponding to junction points of first and second switches between first and second supply voltage terminals that apply first and second supply voltages, respectively, the intermediary supply voltage maintaining a voltage between the first and second supply voltages;

disconnecting means for disconnecting said output terminals from the intermediate supply terminal;

connecting means for connecting each output terminal to the first or to the second power supply voltage by turning on the first or second switch of a corresponding stage of the column control stages, according to an addressing reference value; and delaying means for delaying, during the precharge or the predischarge, at the intermediary supply voltage, the connecting of each output terminal to the first or to the second power supply voltage with respect to the disconnecting of the output terminal from the intermediate supply terminal.

7. The circuit of claim 6, wherein the delaying means delays the connecting by a delay that is selected according to a recovery time of parasitic diodes of N-channel MOS transistors forming a switch of connection of said intermediary voltage to the output terminals.

8. The circuit of claim 6, wherein the delay means includes a resistive and capacitive cell that shift an edge of deactivation of a precharge or predischarge activation signal that activates the precharge or predischarge.

9. The circuit of claim 6, wherein the delay means includes generating means for generating a delayed internal signal from a precharge or predischarge activation signal.

10. The circuit of claim 9, wherein the delay means includes means for generating, from said internal signal, activation and reset signals that respectively activate and reset flip-flops placed at an output of a circuit structured to generate control signals of said column control stage switches.

11. A circuit to control a plasma display panel, comprising:

first and second switches coupled between first and second supply voltage terminals, the first and second switches being coupled to each other at an output terminal, the output terminal structured to drive a cell of the plasma display panel;

a third switch coupled between an intermediate voltage terminal and the output terminal, the third switch structured to perform a precharge or a predischarge of the cell of the plasma display panel to an intermediate voltage between a first supply voltage at the first supply voltage terminal and a second supply voltage at the second supply voltage terminal; and a control circuit coupled to at least one control terminal of the third switch and at least one of the first and second switches, and structured to cause the third switch to disconnect the output terminal from the intermediate voltage terminal and connect the output terminal to the first or to the second supply voltage terminal, by turning on the first or second switch according to an addressing reference value, wherein the control circuit includes a delay circuit structured to delay the connecting of the output node to the first or to the second power supply voltage terminal when the output terminal is at the intermediate voltage.

12. The circuit of claim 11, wherein the third switch includes N-channel MOS transistors having parasitic diodes and the delay circuit is structured to delay the connecting by a delay that is selected according to a recovery time of the parasitic diodes.

13. The circuit of claim 11, wherein the delay circuit includes a resistive and capacitive cell structured to shift an edge of deactivation of a precharge or predischarge activation signal that activates the precharge or predischarge.

14. The circuit of claim 11, wherein the control circuit includes:

an activate flip-flop structured to control one of the first and second switches; and a reset flip-flop structured to control the third switch, wherein the delay circuit is structured to control the one of the first and second switches in a manner that delays the connecting of the output node to the first or to the second power supply voltage with respect to the disconnecting of the output terminal from the intermediate supply terminal.

15. The circuit of claim 11 wherein the third switch is a bidirectional switch that includes:

a fourth switch coupled between the intermediate supply terminal and a first intermediate node and having a control terminal;

a fifth switch coupled between the first intermediate node and the output terminal and having a control terminal, the control terminals of the fourth and fifth switches being coupled to one another at a second intermediate node;

a current mirror connected to the second intermediate node; and a sixth switch structured to control the current mirror and having a control terminal controlled by the delay circuit.

16. A plasma display panel, comprising:

a cell; and a circuit for controlling the cell, the circuit including:

first and second switches coupled between first and second supply voltage terminals, the first and second switches coupled to each other at an output terminal, the output terminal structured to drive the cell of the plasma display panel;

a third switch coupled between an intermediate voltage terminal and the output terminal, the third switch structured to pass a precharge current or a predischarge current of the cell of the plasma display panel; and a control circuit coupled to a control terminal of the third switch and at least one of the first and second switches, the third switch structured to disconnect the output terminal from the intermediate voltage terminal and connect the output terminal to the first or to the second supply voltage terminal by turning on the first or second switch according to an addressing reference value, wherein the control circuit includes a delay circuit structured to delay, when the output terminal is at an intermediate voltage level, the intermediate voltage level being between a first supply voltage level at the first supply voltage terminal and a second supply voltage level at the second supply voltage terminal, the connecting of the output node to the first or to the second supply voltage terminal with respect to the disconnecting of the output terminal from the intermediate voltage terminal.

17. The plasma display panel of claim 16, wherein the third switch includes N-channel MOS transistors having parasitic diodes and the delay circuit is structured to delay the connecting by a delay that is selected according to a recovery time of the parasitic diodes.

18. The plasma display panel of claim 16, wherein the delay circuit includes a resistive and capacitive cell that shift an edge of deactivation of a precharge or predischarge activation signal that activates the precharge or predischarge.

19. The plasma display panel of claim 16, wherein the control circuit includes:

an activate flip-flop structured to control one of the first and second switches; and a reset flip-flop structured to control the third switch, wherein the delay circuit is structured to control the one of the first and second switches in a manner that delays the connecting of the output node to the first or to the second power supply voltage with respect to the disconnecting of the output terminal from the intermediate voltage terminal.

20. The plasma display panel of claim 16 wherein the third switch is a bidirectional switch that includes:

a fourth switch coupled between the intermediate voltage terminal and a first intermediate node and having a control terminal;

a fifth switch coupled between the first intermediate node and the output terminal and having a control terminal, the control terminals of the fourth and fifth switches being coupled to one another at a second intermediate node;

a current mirror connected to the second intermediate node; and a sixth switch structured to control the current mirror and having a control terminal controlled by the delay circuit.

21. A plasma cell control circuit, comprising:

a discharge switch having a first terminal coupled to a power supply node and a second terminal coupled to an output node, the output node structured to drive a cell of a plasma display panel, the discharge switch configured to pass current to discharge the cell;

a pre-discharge switch having a first terminal coupled an intermediate power supply node and a second terminal coupled to the output node;

an intermediate control circuit configured to signal the pre-discharge switch to couple the intermediate power supply node to the output node during a pre-discharge phase and configured to signal the pre-discharge switch to de-couple the intermediate power supply node from the output node during a discharge phase; and a delay circuit operative during the pre-discharge phase when the output node is at an intermediate power level and configured to delay the coupling of the output terminal to the power supply node until the output node is de-coupled from the intermediate power supply node.

22. The plasma cell control circuit of claim 21, wherein the delay circuit is configured to generate a delay selected according to a recovery time of parasitic diodes of at least one transistor forming the pre-discharge switch.

23. The plasma cell control circuit of claim 21, wherein the delay circuit includes a resistive and capacitive cell structured to delay an edge of deactivation of a pre-discharge activation signal.

24. The plasma cell control circuit of claim 23, further comprising flip-flops formed at an output of a control signal generation circuit configured to generate the pre-discharge activation signal.

25. The plasma cell control circuit of claim 21, further comprising:

a charge switch having a first terminal coupled to a second power supply node and a second terminal coupled to the output node, the charge switch configured to pass current to charge the cell, wherein the intermediate control circuit is further configured to couple the intermediate power supply node to the output node during a pre-charge phase and further configured to de-couple the intermediate power supply node from the output node during a charge phase, and wherein the delay circuit is further configured to delay the coupling of the output terminal to the second power supply node until the output node is de-coupled from the intermediate power supply node.

* * * * *